United States Patent [19]

Deal

[11] 3,971,148

[45] July 27, 1976

[54] DREDGE CUTTER HEAD

[76] Inventor: Troy M. Deal, 277 Trismen Terrace, Winter Park, Fla. 32789

[22] Filed: Feb. 10, 1975

[21] Appl. No.: 548,576

[52] U.S. Cl. ..... 37/66; 198/213; 56/9

[51] Int. Cl.[2] ..... E02F 3/88

[58] Field of Search ..... 37/66, DIG. 8; 172/112, 172/132; 171/85; 198/213, 217, 228; 56/9

[56] References Cited

UNITED STATES PATENTS

| | | | |
|---|---|---|---|
| 1,747,139 | 2/1930 | Mourar | 171/85 |
| 1,786,170 | 12/1930 | Reiter | 171/85 |
| 2,905,506 | 9/1959 | Kristensen | 37/66 X |
| 3,521,387 | 7/1970 | Degelman | 37/66 |
| 3,521,712 | 7/1970 | van der Lely et al. | 172/112 |
| 3,556,223 | 1/1971 | Pardy | 171/85 |
| 3,738,029 | 6/1973 | Harmon | 37/66 |

FOREIGN PATENTS OR APPLICATIONS

| | | | |
|---|---|---|---|
| 1,037,614 | 9/1953 | France | 37/66 |
| 788,435 | 1/1958 | United Kingdom | 37/66 |

*Primary Examiner*—E. H. Eickholt
*Attorney, Agent, or Firm*—Beaman & Beaman

[57] ABSTRACT

A dredge cutter head having mutually self-cleaning augers with a shrouded hood for nonstirring and non-clogging operation.

5 Claims, 5 Drawing Figures

DREDGE CUTTER HEAD

BACKGROUND OF THE INVENTION

The invention relates to improvements in dredging machines of the type disclosed in U.S. Pat. No. 3,521,387 granted July 21, 1970.

In dredging machines of the design of the aforesaid patent, there is a tendency to disperse the dredged fines through surrounding water causing objectionable pollution. Present environmental requirements dictate nonstirring dredging operations. Such operations are particularly difficult to perform, especially in eutrophied waters where the dredging involes the harvesting of a large amount of vegetation.

BRIEF DESCRIPTION OF THE INVENTION

It is an object of the invention to provide a self-cleaning, nonstirring, dredging cutter head combining parallel and geared together timed augers that turn together inside a shrouded hood so the augers mutually clean each other as they turn to transport material to the suction pipe.

The shrouded hood and suction pipe act as an underwater vacuum cleaner and contain the moving dredged material, thereby insuring that cut material and fines are not dispersed through surrounding water, but instead are processed through the suction pipe for disposal.

In the illustrated form, the shrouded head extends over both augers and consists of two sections, one of which is preferably hinged to act as a backhoe as well as to closely approach the front auger when sand alone is being dredged. Raising and lowering the hinged section will assist in pulling down floating vegetation into the auger teeth without the suction pipe losing its prime by breaking the surface of the water.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

The improved dredge cutter head 10 is shown supported on the dredge boom 12 which may, in turn, be supported and raised and lowered in any suitable manner, for example, as shown in the aforesaid patent.

Figure 5:
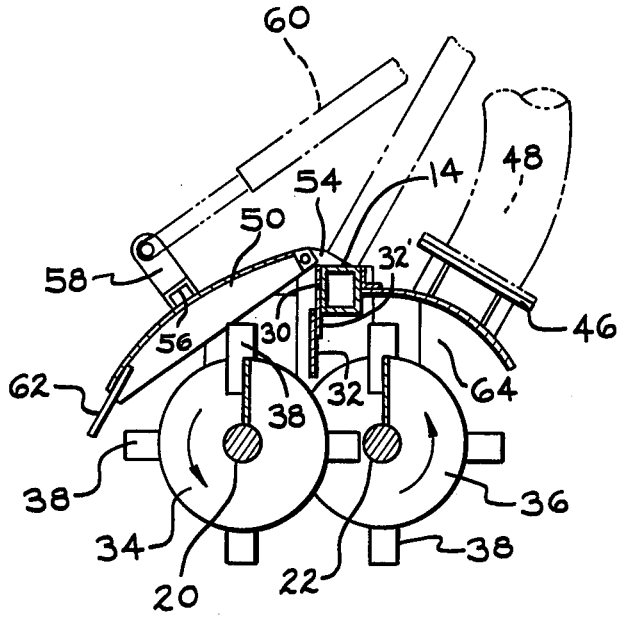
FIG. 5 is a sectional view taken on line V—V of FIG. 2.

The head 10 comprises an elongated frame member 14 extending in opposite directions from the bearing mounting bracket 16 shown in FIG. 5. The center bearings 18 for the auger shafts 20 and 22 are carried on the bracket 16 with the outboard bearings 18' for the shafts 20 and 22 being carried in the gear boxes 24 and 26 attached to the outer ends of the member 14 through plates 28.

An elongated plate 30 is attached to the front side of the member 14 to which the flat spaced teeth 32 are attached to provide a serrated cleaning bar 32' extending substantially the full width of the cutter head 10. Mounted on the shafts 20 and 22 are augers 34 and 36, respectfully, of suitable shape to carry the dredged material toward the center of the head 10.

Figure 4:
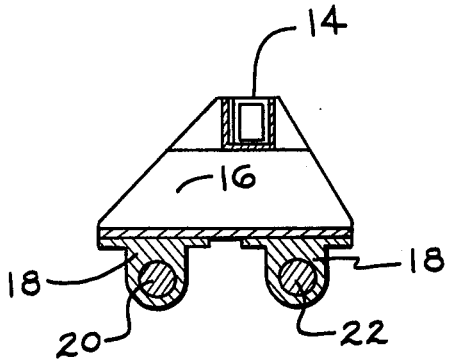
FIG. 4 is a sectional view taken on line IV—IV of FIG. 2.

Teeth 38 are so spaced on the augers 34 and 36 that, upon rotation of the augers 34 and 36, the teeth 38 freely pass between teeth 32 of the cleaning bar 32'. The total number of teeth 38 on the augers 34 and 36 correspond to the number of adjacent pairs of teeth 32 on the bar 32'. In FIG. 4 it will be noted that the spacing of the shafts 20 and 22 and the length of the teeth 38 is such that upon rotation the teeth 38 slightly clear the shafts 20 and 22 for reasons hereinafter described.

A suitable drive motor, such as an hydraulic motor 40, actuated from a pump on the dredge (the hydraulic lines being omitted) rotate the shafts 20 and 22 in the same direction through the gear boxes 26, the direction of rotation being indicated by the arrows in FIG. 4.

The shrouded hood 42 of the cutter head 10 in the illustrated form comprises a rear section 44 fixed to the member 14 by an angle bar 44' and extending substantially the entire width of the head 10 to project above and partially embrace the auger 36. In the center of the head 10 an opening is provided in the section 44 to receive the flanged intake pipe 46 to which the suction line 48 (shown in dotted outline in FIG. 4) is attached.

To complete the hood 42, a front section 50, coextensive with the rear section 44, is pivoted at spaced points 52 to the brackets 54 attached to the member 14. A reinforcing channel 56 is attached to the section 50 has an upright portion 58 to which the hydraulic piston 60 (shown in dotted outline) is attached. A similar upright and piston (not shown) is preferably employed on the opposite side of the center of the head 10. Teeth 62 are shown spaced along the lower edge of the section 50 to aid in pulling floating vegetation down into the auger 34 and to permit effective use of the section 50 as a "backhoe".

OPERATION OF THE ILLUSTRATED FORM

Figure 1:
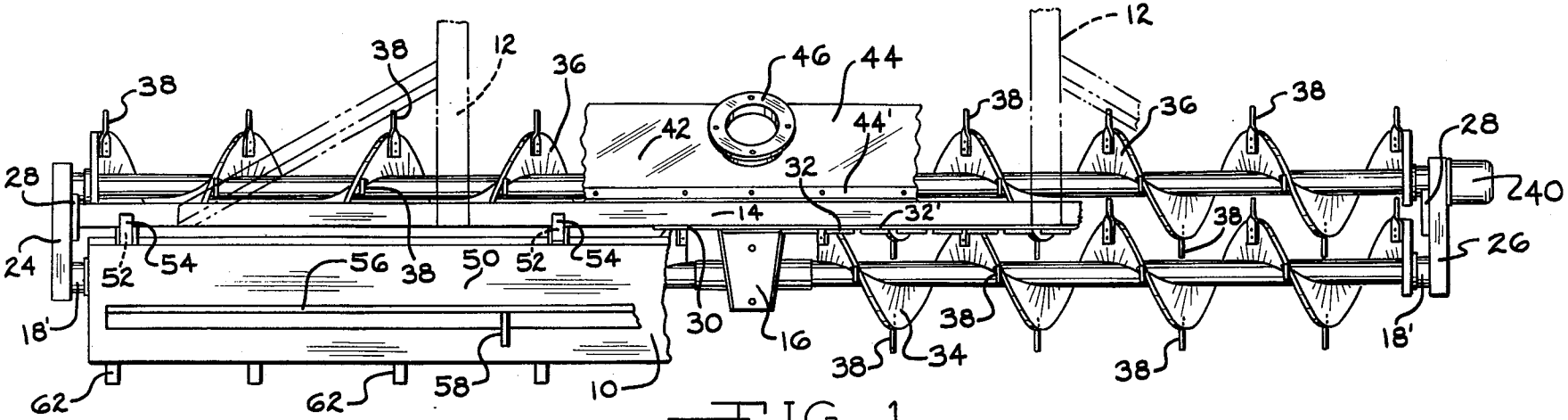
FIG. 1 is a top view of the cutter head with the dredge boom supporting the head being shown in dotted outline.
Figure 2:
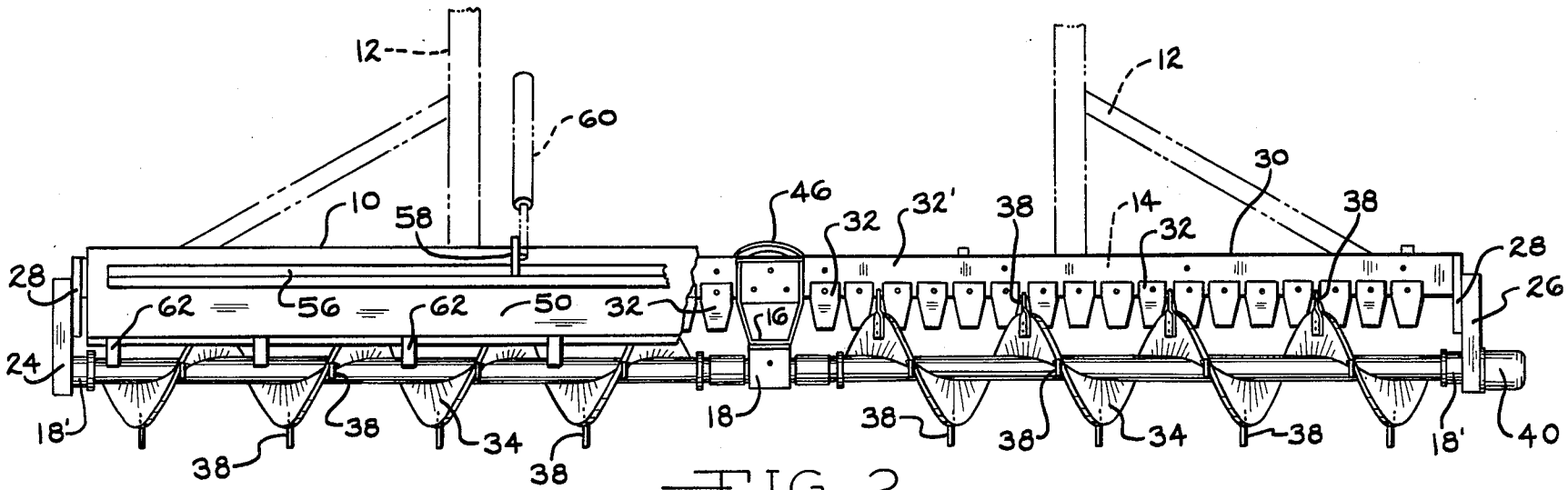
FIG. 2 is a front view of the cutter head shown in FIG. 1.
Figure 3:
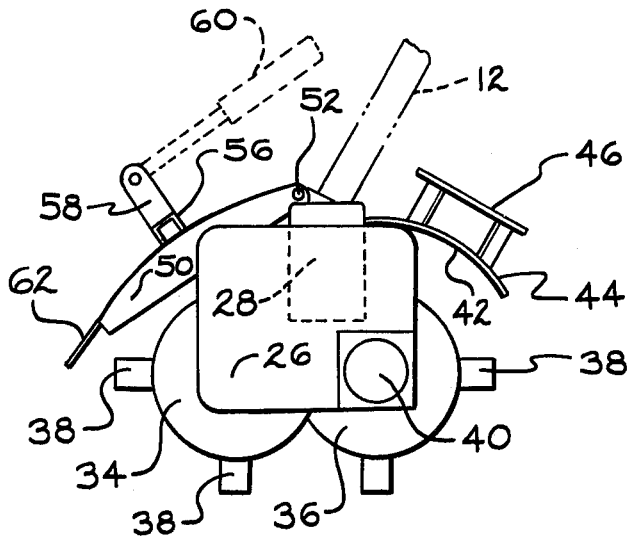
FIG. 3 is an end view of FIG. 1 taken from the right hand end.

Referring to FIG. 1, it will be noted that the screw surfaces of the augers 34 and 36 are similar and they are similarly arranged on their respective shafts 20 and 22 and timed through the gear boxes 24 and 26 so as to rotate with the relationship shown. Thus, there is no rotational interference between the projecting teeth 38 yet lines parallel to the axes of rotation of the shafts 20 and 22 and through the teeth 38 will intersect. This results in chopping and cutting the vegetation as the teeth 38 pass between the teeth 32 of the cutter bar 32'. The teeth 38 also perform a cleaning operation on the shaft of the opposite auger due to the slight rotational clearance between the teeth 38 of one auger and the shaft of the other auger.

By having a common cutter bar 32' for the augers 34 and 36, each tooth 38 tends to shear vegetation, roots, etc., on the same side of the bar 32' and remove vegetation, roots, etc., from the other side. Thus, there is a continuous unidirectional cutting and clearing action taking place in the passageway 64 defined between the under side of the shrouded hood 42 defined by the sections 44 and 50 and the shafts 20 and 22. The mixture of water and dredged material flows upwardly and inwardly toward the center of the cutter head 10 into the passageway 64 which, in turn, communicates with the intake 46. This action is quite comparable to a vacuum cleaner nozzle with the result that the dredging fines are not substantially dispersed into the surrounding water.

I claim:

1. A dredge cutter head comprising a horizontally disposed auger structure, comprising two augers supported for rotation about parallel axes, means for rotating said augers in timed relation in the same direction, a slotted cutting bar disposed above and between said axes, radial projections axially spaced along said augers and disposed in common planes normal to said axes, said projections in each common plane traversing a common slot of said bar from different directions, the projections on one auger having an upward arcuate movement through the common slot and the projections on the other auger having a downward arcuate movement through the same slot in timed relation, a hood comprising front and rear sections substantially coaxial with said auger structure and located on opposite sides of said bar to provide a passageway between said structure and the under surfaces of said hood sections, an opening defined in said rear hood section, and a suction inlet communicating with said passage through said opening whereby dispersion of dredged material into the surrounding water is mitigated.

2. A dredge cutter head as defined in claim 1 wherein said rear hood section is fixed and said front hood section is movable about an axis parallel to the axis of said augers, and means for moving said front hood section in the same direction as said augers are rotated whereby the front edge thereof acts to move material toward said augers and said rear hood section.

3. A dredge cutter head as defined in claim 2 wherein said movable section has spaced projections along said front edge thereof to assist in the use of said movable section as a "backhoe" to move material toward said auger structure.

4. A dredge cutter head as defined in claim 3, said auger structure projections which intersect a line between the projections of said movable section in one position of movement of the latter.

5. A dredge cutter head as defined in claim 1 wherein said auger structure comprises a pair of parallel shafts embraced by screw surfaces, projections spaced along the outer edge of the screw surface of one of said shafts and having slight rotational clearance with the other shaft.

* * * * *